United States Patent [19]

Yabe

[11] Patent Number: 4,548,511

[45] Date of Patent: Oct. 22, 1985

[54] ELECTRONIC TIMEPIECE WITH VOICE MEMORY

[75] Inventor: Hiroshi Yabe, Suwa, Japan

[73] Assignee: Kabushiki Kaisha Suwa Seikosha, Tokyo, Japan

[21] Appl. No.: 430,427

[22] Filed: Sep. 30, 1982

[30] Foreign Application Priority Data

Oct. 8, 1981 [JP] Japan ..... 56-160689
Jun. 14, 1982 [JP] Japan ..... 57-101535
Sep. 8, 1982 [JP] Japan ..... 57-156098

[51] Int. Cl.[3] ..... G04B 47/00; G04B 21/08

[52] U.S. Cl. ..... 368/10; 368/63; 369/50

[58] Field of Search ..... 368/10, 41, 63; 360/8, 360/71, 74.4; 365/45; 369/50; 381/110

[56] References Cited

U.S. PATENT DOCUMENTS 3,919,834 11/1975 Murakami et al. ..... 368/63
4,120,009 10/1978 Iwasawa ..... 360/71
4,130,739 12/1978 Patten ..... 360/8
4,368,988 1/1983 Tahara et al. ..... 368/63
4,413,290 11/1983 Furuta ..... 369/50

*Primary Examiner*—Vit W. Miska
*Attorney, Agent, or Firm*—Blum, Kaplan, Friedman, Silberman & Beran

[57] ABSTRACT

An electronic timepiece with voice memory includes an auto start circuit which senses the presence of an input voice and automatically controls the start of recording. Voices inputted from the outside are coded and the coded data is stored in memory. An output means reads out the memory contents and transforms the coded contents into an analog voice signal. When the incoming voice exceeds a predetermined level, the recording means is automatically started by an output from a level detector. Memory is divided into at least two regions. The first region stores coded voice data before the autostart circuit operates and later coded voice data is recorded in the second region after the autostart circuit operates so that the initial portions of speech are not lost.

41 Claims, 11 Drawing Figures

FIG. 2
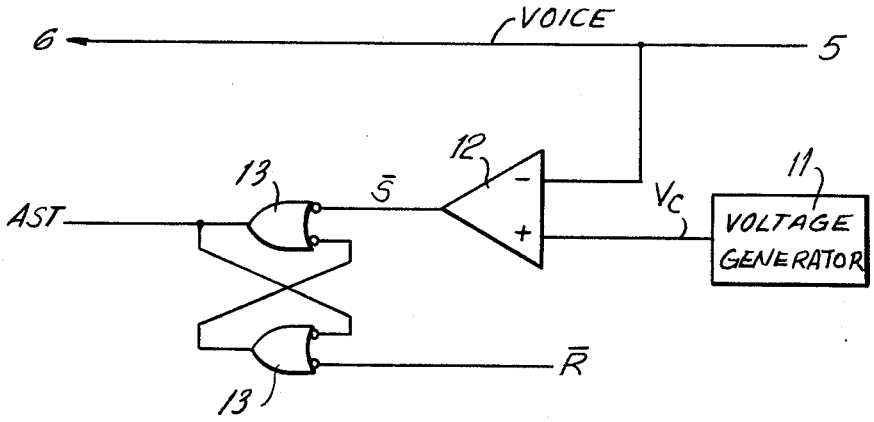
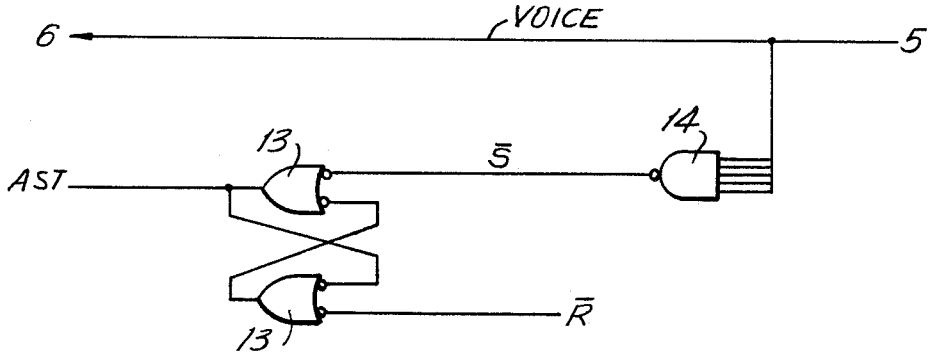
FIG. 3

FIG. 4
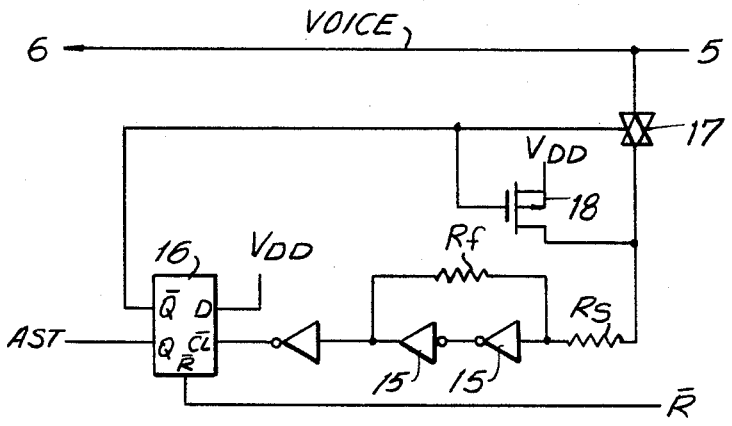
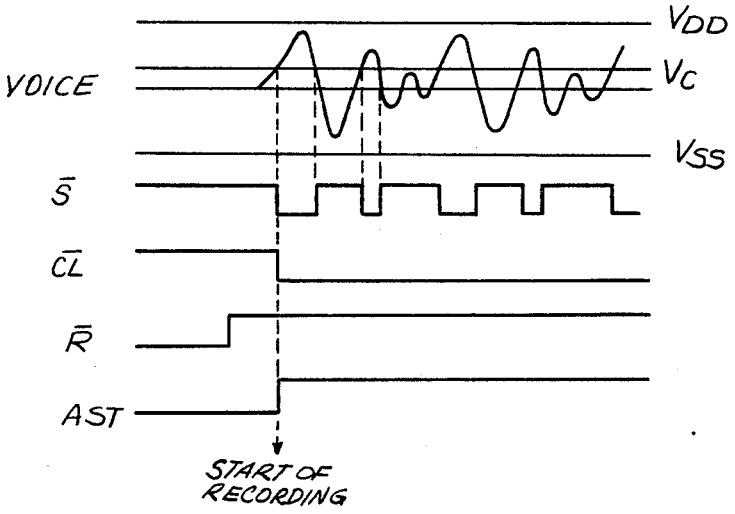
FIG. 5

FIG. 6
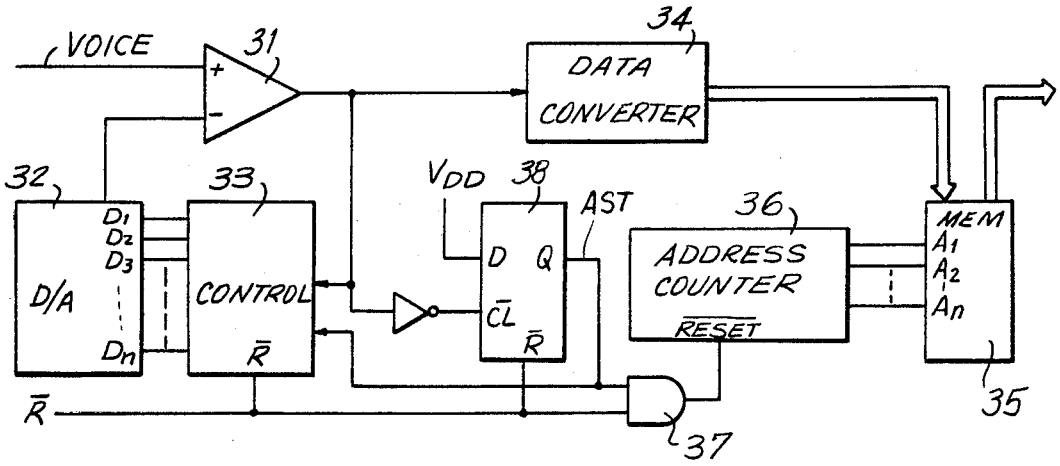
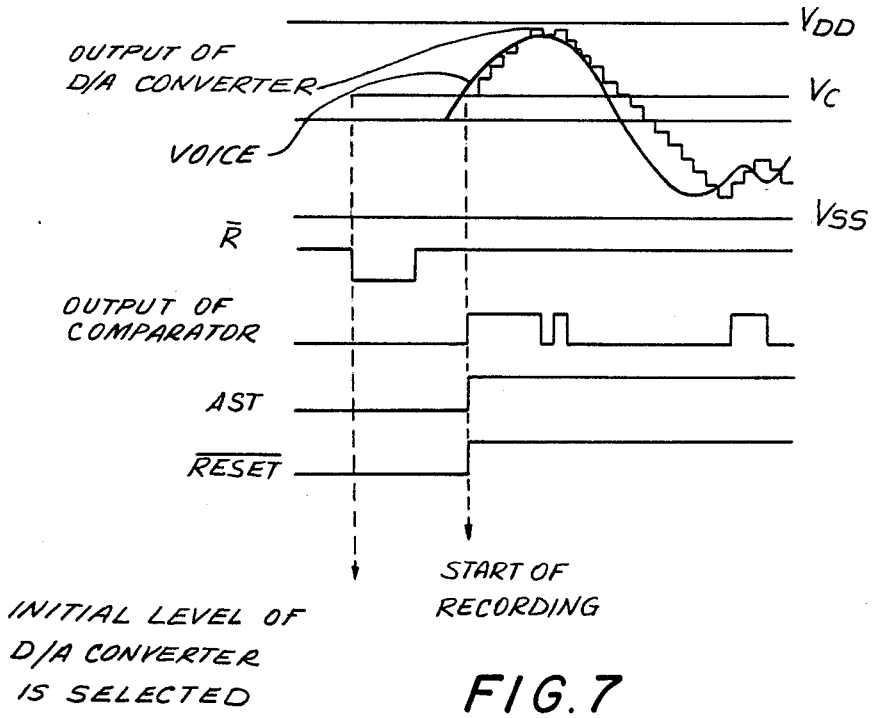
FIG. 7

FIG. 8
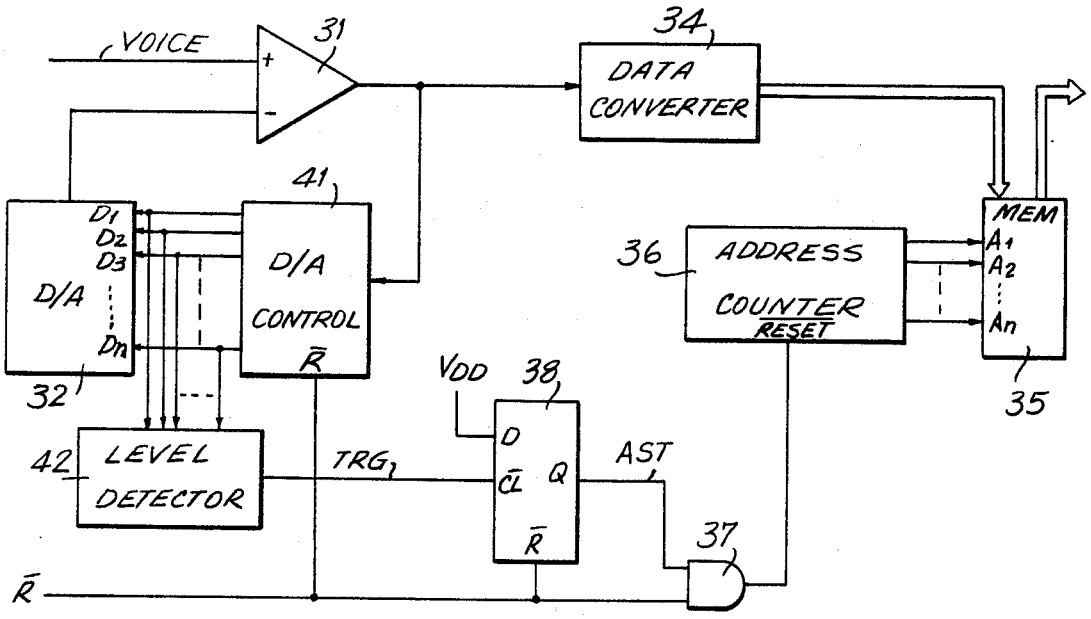
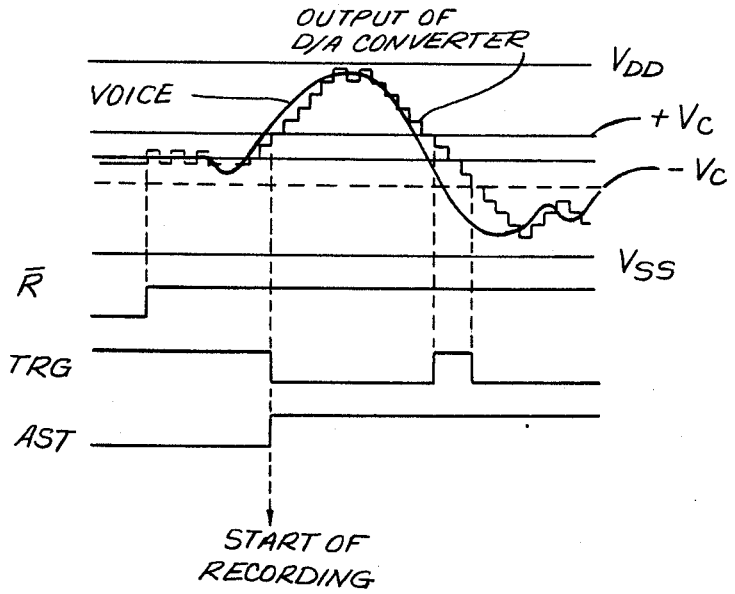
FIG. 9

ELECTRONIC TIMEPIECE WITH VOICE MEMORY

BACKGROUND OF THE INVENTION

This invention relates generally to an electronic timepiece having supplemental functions and more particularly, to an electronic timepiece having a function for recording and playing back the user's voice in association with a function. By "voice" it is meant all sounds such as the human voice, music or synthesized sounds. Currently, electronic timepieces although small are developed to have multifunctions such as an alarm function or a timer function. However, the warning or notice technique of these functions is no more than a sound determined by the manufacturer. Users must use the sound incorporated in the timepiece whether or not they find it suitable and pleasant or not. Further, there is a disadvantage that the user must recognize the sound and recall from his mental memory what the sound means. The disadvantages stated above can be eliminated in an electronic timepiece by incorporation therein of a recording and playback function. Thus, the user's voice may be stored in memory and be reproduced as a voice at the suitable time to announce, for example, the alarm function. In such a small device little memory capacity is available and therefore should not be wasted. To begin recording, the electronic timepiece requires some starting signals. However, it is troublesome for the users to supply these signals by, for example, operating an external switch. When this is done the time elapsed from applying the starting signal until talking is initiated results in a waste of memory storage capacity.

What is needed is an electronic timepiece having a voice recording and playback capability which begins recording without troublesome switching operations by the operator and with little waste of memory storage capacity.

SUMMARY OF THE INVENTION

Generally speaking, in accordance with the invention, an electronic timepiece with a voice memory especially suitable for efficient use of the memory storage capacity is provided. The electronic timepiece includes an auto start circuit which senses the presence of an input voice and automatically controls the start of recording. Voices inputted from the outside are coded and the coded data is stored in memory. An output means reads out the memory contents and transforms the coded contents into an analog voice signal. When the incoming voice exceeds a predetermined level, the recording means is automatically started by an output from a level detector.

In an alternative embodiment the memory is divided into at least two regions. The first region stores coded voice data before the auto-start circuit operates and further coded voice data is recorded in the second region after the auto-start circuit operates so that the initial portions of speech are not lost.

Accordingly, it is an object of this invention to provide an improved electronic timepiece with a recording and playback capability.

Another object of this invention is to provide an improved electronic timepiece with a voice memory having an auto-start construction for initiating recording simultaneously with the voice input.

Still another object of this invention is to provide an improved electronic timepiece with a voice memory which starts recording solely on the occurrence of a voice and does not lose the initial speech portion.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 2, 3, 4 are alternative embodiments of auto-start circuits of FIG. 1;

FIG. 5 is a timing chart of signals associated with the circuits of FIGS. 1–4;

FIG. 6 is an alternative embodiment of a circuit of an electronic timepiece with voice memory in accordance with the invention;

FIG. 7 illustrates waveforms associated with the circuit of FIG. 6;

FIG. 8 is another alternative embodiment of an auto-start circuit for use in an electronic timepiece with voice memory in accordance with the invention;

FIG. 9 shows waveforms associated with the circuit of FIG. 8;

DESCRIPTION OF THE PREFERRED EMBODIMENTS

Figure 1:
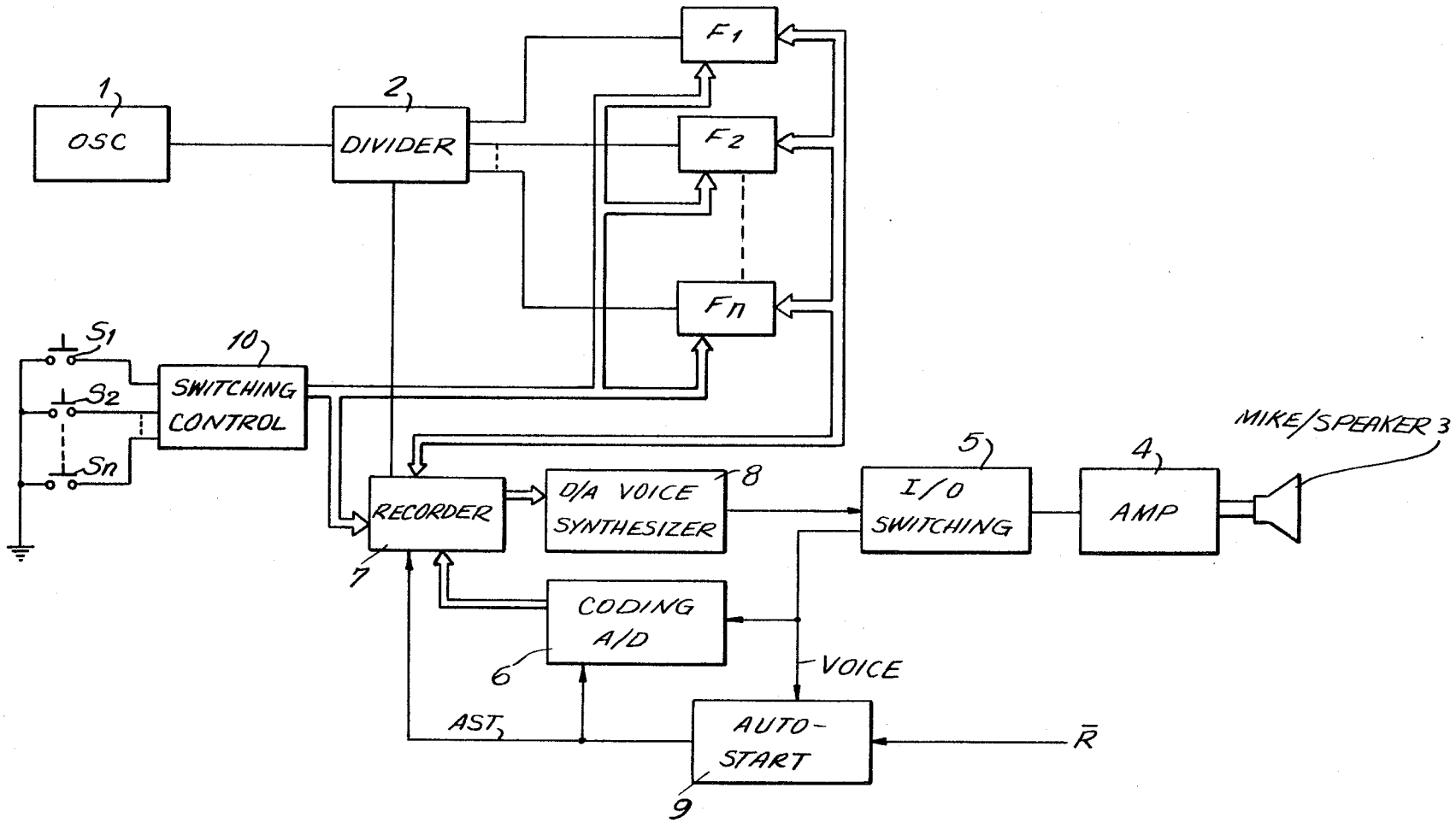
FIG. 1 is a circuit of an electronic timepiece with voice memory in accordance with the invention.

FIG. 1 is a block diagram of an electronic circuit for an electronic timepiece with a voice memory in accordance with the invention. The circuit includes an oscillation circuit 1 generating a standard clock signal, divider circuit 2 receiving said standard clock signal and forming by division the required signals as known in the art, various functional circuits F1 . . . Fn, such as a timekeeping circuit and display circuit.

The circuit also includes a microphone 3 which also serves as a loudspeaker. The microphone 3 is connected with an input/output switching circuit 5 through an amplifier 4. A code circuit 6 serves to encode analog voice signals, identified in FIG. 1 as "Voice" in digital quantities. The coded digital signal is stored in a recorder 7. The analog-to-digital coding circuit 6 and the recorder 7 operate when an auto-start circuit 9 provides an output signal AST which goes high, that is, a 1 level. The recorder 7 is generally constructed as a semi-conductor memory such as a random access memory (RAM) or a shift register. Read-in and readout are performed in synchronism with a timing signal derived from the divider circuit 2. A voice signal synthesizing circuit 8 receives the digital signal outputs from the recorder 7 and outputs an analog voice signal.

The auto-start circuit includes a level detector to detect when the level of signal of the inputted Voice comes up to a predetermined level. The auto-start circuit 9 also includes a starting control circuit to make the record auto-start signal AST go high in response to the output of the level detector. When the voice input signal exceeds the predetermined level, and the signal AST goes high, the auto-start circuit 9 drives the coding circuit 6 and the recorder 7. $\overline{R}$ is a reset signal which resets the auto-start circuit 9 such that the output AST is low or zero. A switching control circuit 10 provides signals required to control each function in response to the inputs at the switches S1-Sn.

FIGS. 2–4 are alternative embodiments of auto-start circuits 9 of FIG. 1 and FIG. 5 is a timing chart showing conditions when starting to record.

The circuit of FIG. 2 includes a standard voltage (Vc) generating circuit 11, level detector 12 using an operational amplifier and NAND gates 13 forming a set reset latch in which the output of the level detector 12 is the set signal. The level detector 12 outputs a low level signal, that is, logic zero, when a voice signal "Voice" is higher than the standard voltage Vc from the voltage generator 11. As illustrated in the timing chart of FIG. 5, the NAND gate 13 set-reset circuit operates as a starting control circuit. The signal AST goes high when the voice level exceeds the level Vc to commence the coding and recording operations of the functions 6, 7 of FIG. 1. A very slight lag is indicated between the initiation of voice and the initiation of recording by the signal AST going high.

FIG. 3 shows an embodiment of an auto-start circuit using a gate as a level detector wherein all inputs to a multi-input NAND gate 14 are connected to increase the number of P-MOSFET which are switched ON in parallel, and to increase the logical threshold level Vth of the transistors to Vc. The output of the NAND gate 14 is inverted when the voice signal Voice exceeds Vc. The set-reset circuit using NAND gates 13 is the same as that of FIG. 2 in function and construction. Timing and operation of the circuit are the same as the timing of FIG. 2 as illustrated in the timing chart of FIG. 5. In alternative embodiments a multi-input NOR gate may be used, or an inverter having a difference Vth between P and N MOSFETS as a level detector may be used.

FIG. 4 is an alternative embodiment of an auto-start circuit 9 using Schmitt trigger circuit, formed of two inverters 15 and two resistors Rf, Rs, which serves as a level detector. The constants of the element forming this Schmitt trigger circuit are fixed so that logical threshold voltage Vth becomes Vc when the input goes from zero to one. The input to the clock terminal $\overline{CL}$ of a flip-flop 16 goes low when the voice signal Voice traverses Vc from the Vss side. The flip-flop 16 operates as a starting control circuit in which an input at the D terminal is outputted at the Q terminal on the fall of the signal $\overline{CL}$. Further, the circuit includes a transmission gate 17 and a P-type MOSFET 18. The transmission gate 17 is switched OFF and the P-MOSFET 18 is switched ON when the signal AST, that is, the Q output of the flip-flop 16, goes high to separate the Schmitt trigger circuit from Voice and to connect the input of the Schmitt trigger circuit with VDD. These operations are preformed so as not to exert the influence of the Schmitt input impedance on the Voice signal after recording commences.

In an alternative embodiment in accordance with the invention, the transmission gate 17 is omitted by changing the values of the resistors Rs, Rf. FIG. 5 also illustrates the timing chart of the embodiment of FIG. 4.

FIG. 6 is an alternative embodiment in accordance with the invention and FIG. 7 is a timing chart associated with the circuit of FIG. 6, indicating the start of recording when using a delta modulation (DM) technique of storing voice signals. The circuit of FIG. 6 includes a comparator 31, which compares the amplitude level of output of a digital/analog converter 32 with that of a voice input Voice. The output of the comparator 31 goes high when the Voice signal is relatively larger and the output of the comparator 31 goes low when the voice signal is relatively small. A circuit 33, by obtaining the output of the comparator 31, controls the digital/analog converter 32 by controlling the data D1 . . . Dn provided to the digital/analog converter, so as to have the output level of the digital/analog converter 32 approach as closely as possible to the amplitude level of the voice.

In this circuit, the initial state is fixed by the same reset signal $\overline{R}$ as that of FIGS. 1 and 2. Data to fix the output of the digital/analog converter 32 at the level Vc is continuously output as long as the record auto-start signal is low, and the above operation begins when the signal AST goes high. A data converting circuit 34 converts data obtained from the comparator into a form which is easy to store in a memory 35. When utilizing, for example, a shift register for the memory 35, the data convert circuit 34 is unnecessary. An address counter 36 for the memory operates when output $\overline{Reset}$ of an AND gate 37 becomes high. So this circuit operates only when both the AST and $\overline{R}$ signals go high simultaneously.

A flip-flop 38 outputs a D input to the Q terminal on the falling portion of a signal $\overline{CL}$. Therefore, in this embodiment, the voice level becomes higher than the output level Vc of the digital/analog converter 32 after $\overline{R}$ goes high and as soon as the output of the comparator 31 goes high. Then, Q output AST of the flip-flop 38 goes to the high level to start recording. The comparator 31, digital/analog converter 32 and the digital analog converter control circuit 33 are used in combination as a level detector in accordance with the invention. The starting control circuit is constructed of the flip-flop 38 and AND gate 37 in the embodiment of FIG. 6. Operation of this embodiment is illustrated in the timing chart of FIG. 7.

FIG. 8 is another alternative embodiment in accordance with this invention using delta modulation and the timing chart of FIG. 9 shows operation of the circuit of FIG. 8. In FIG. 8, reference numerals 31, 32, and 34–38 represent the same functional elements as those in FIG. 6. A digital/analog converter control circuit 41, by receiving the output of the comparator 31, controls data D1 . . . Dn provided to the digital/analog converter 32 so that the output level of the digital/analog converter 32 may approach the amplitude level of the Voice signal as closely as possible. The digital/analog converter control circuit 41 is in a state of establishing initial value during the period when $\overline{R}$ is low, and delivers data to make the output of the digital/analog converter 32 be approximately ½ of the power source voltage. A level detector 42 reads out the data D1 . . . Dn sent from the digital/analog converter control circuit 41 to the digital/analog converter 32. The level detector 42 detects from the digital data what state the output of the digital/analog converter 32 is in relative to the established value ±Vc and delivers the trigger signal TRG. In this embodiment, the level detector 42 is constructed to deliver a trigger signal TRG which is high when the output of the digital/analog converter 32 is between −Vc and +Vc. The level detector 42 is constructed to deliver a trigger signal TRG which is low when the detected signals are not within the above cited range. The timing chart (FIG. 9) shows operation of this embodiment.

The manner in which the digital/analog converter 32 follows the voice signal as shown in the embodiments represented by FIGS. 6–9 is not limited to these constructions, but variations may be made in accordance with the construction of the digital/analog converter control circuit 33, 41.

As stated above, with simple circuit arrangements in accordance with this invention, the construction for starting to record automatically and virtually simultaneously with the initiation of voice can be obtained without any complicated operation to be performed by the person making the recording at the time of recording. Also, it is possible to avoid wasting memory capacity, especially since the capacity is very limited in timepieces. Further, by applying this invention, it is possible to store a record of the duration of silent time between "voices" without recording during the silent time. Later the silent periods may be synthesized when outputting the above data. Thereby, the required memory capacity is extremely reduced.

Figure 10:
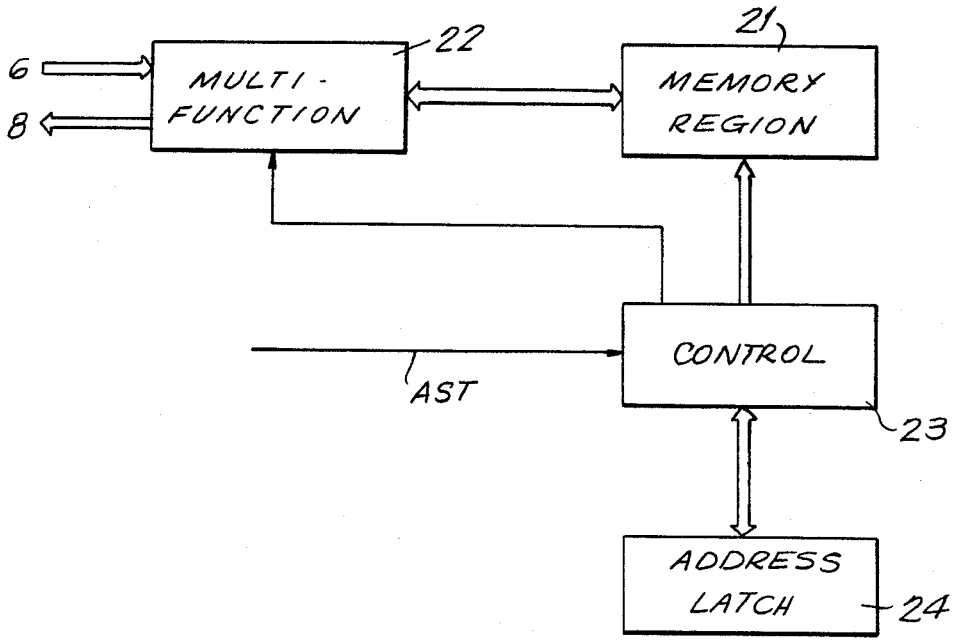
FIG. 10 is a functional block diagram of a recorder for use in an electronic timepiece with voice memory in accordance with the invention.
Figure 11:
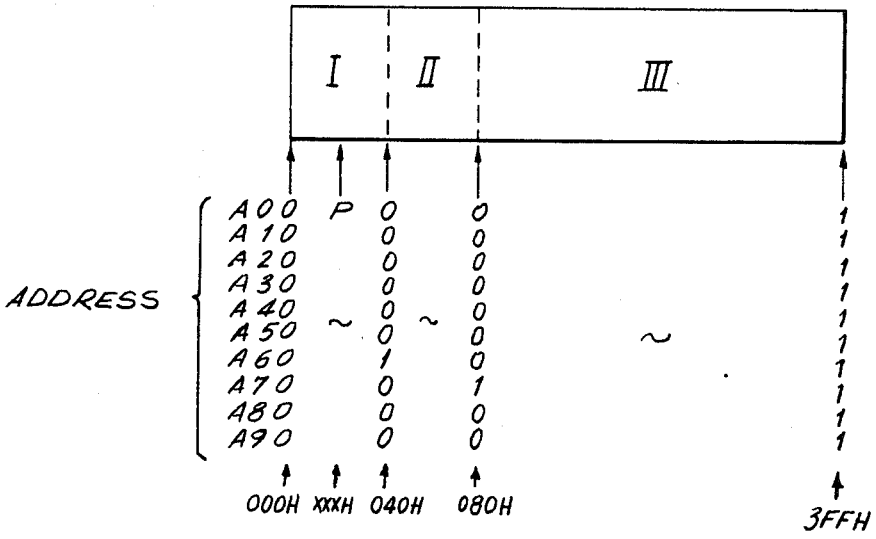
FIG. 11 shows the divided form of the record memory region using RAM of the recorder of FIG. 10.

The circuit of FIG. 1 and its auto-start embodiments as described above are very advantageous in determining the presence of an input voice and automatically controlling initiation of recording. However, the auto-start circuit controls the start of recording only after detecting the voice input. So, taking account of the time required to detect the voice input, the inputted voice cannot be recorded in its very initial stage and a momentary miss occurs in the initial portion of the voice signal. This disadvantage is overcome by an alternative construction in accordance with the invention shown in FIG. 10 which is a block diagram of the recorder 7 in FIG. 1. FIG. 11 illustrates one divided form of a record memory region when using a RAM as the memory. The diagram of FIG. 10 includes a record memory region 21 using RAM. Reference numeral 22 represents functions including a Read/Write switching circuit and a data transformation circuit to transform data obtained from a code circuit into a signal suitable for being written into RAM and to transform data read from RAM into a signal suitable for being transferred to the voice signal synthesizing circuit. The functions 22 are connected for input to the function 6 of FIG. 1 and for output to the function 8 of FIG. 1.

A control circuit 23 performs supervisory control of the recorder as a whole. This control circuit 23 includes a circuit for switching regions and especially controls the address of the RAM. When inputting the record auto-start signal AST, the address at that point is transferred from storage to an address latch 24 which stores the transferred address and returns it to the control circuit 23 when the voice is reproduced. FIG. 11 shows a divided form of a record memory region using RAM as memory. A0-A9 illustrates addresses in the RAM. As illustrated in FIG. 11, the RAM is divided into three regions. In this embodiment, the first region I is formed of 128 words which correspond to the addresses 000H-03FH. The second region II is formed of a 128 words which correspond to the addresses 040H-07FH. The third region III corresponds to the remaining addresses 080H-3FFH. Operation is as follows.

When putting the timepiece in the recording mode, either the first region I or the second region II is selected by a region switching circuit. For instance, when selecting the first signal region I, the data which is obtained from the code circuit 6 is stored in order of address, such as 000H→001H→002H . . . When coming in order to the final address 03FH of the first region I, writing of the data is continued by turning back to the first address of the region I, that is, 03FH→000H→001H . . . .

When the data has been written to the point P, (FIG. 11), the auto-start signal AST from the auto-start circuit is fed to the control circuit 23, which writes the address XXXH, hereinafter referred to as the record auto-start address, into the address latch 24. Then, the continuing data is written into the third region III from 080H to 3FFH. After that, the recording is completed by finishing the writing. If recording is started again after the earlier recording is finished, the second region II is selected this time to perform the same recording operation as described above for the region I. In this way, the regions I and II are switched cyclically.

When reproducing, the region I or II first selected at the time of recording is selected by the region switching circuit, and the record auto-start address XXXH stored in the address latch 24 is set in the control circuit 23. If, for example, the first region I is now selected, the control circuit reads out data in order of address, that is, address XXXH+001→XXXH+002 . . . →03FH→000H→ . . . →XXXH→080H→081H . . . 3FFH. The readout data is transformed by the data transformation circuit 22, transferred to the voice signal synthesizing circuit 8 in FIG. 1, and delivered as audible sound from the speaker 3 by way of the amplifier 4 and switching circuit 5. According to this address order, the foregoing reproduce operation is performed. The memory is addressed from XXXH+001, that is, from the address next to XXXH completely around again to XXXH in region I, and then the address is transferred to region III.

In the case of initially selecting the region II, the control circuit 23 controls the addresses as follows: XXXH+001H→XXXH+00 2H→ . . . →07FH→040H→ . . . →XXXH→080H→081H→ . . . →3FFH.

According to this address order, the foregoing reproduce operation is performed. Region II is read-out and the region III is read out.

It is possible to record the initial voice by the above record and reproduce operation in the time before the record auto-start circuit operates. Therefore, in accordance with the invention, the problem that the beginning of voice recording is clipped due to the lag in the auto-start function is overcome by simply controlling memory address, and a record memory system is obtained in which the auto-start function is favorably utilized. That is, a small portion I or portions I and II are devoted in a recirculating manner to storing the initial speech portions which occur when initiating a recording mode but prior to production of the AST signal. The main storage region III is not wasted by delays in speech initiation when the timepiece is placed in the record mode by operation of a switch S (FIG. 1).

As the capacity of the divided memory regions I, II and III can be established at will in accordance with the design purposes and applications of the circuit, it is to be understood that the invention is not limited to the specific embodiments described above.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece, the improvement therein comprising:

a microphone and loudspeaker means for receiving and outputting voice signals;

recording means for receiving said voice signals from said microphone means and storing voice data representative of said voice signals;

output means for reading out the data stored in said recording means and transforming said data signals into voice signals for output by said loudspeaker means;

a start circuit including a level detector, said level detector detecting the amplitude of voice signals inputted externally to said microphone means, said start circuit initiating operation of said recording means in response to an output from said level detector, said level detector providing said output when the amplitude of said incoming voice signal to said microphone exceeds a predetermined level, said recording means including memory means for storage of said voice data, said memory means comprising a RAM being divided into regions, a first region of said memory means storing said voice data incoming prior to occurrence of said signal from said level detector initiating operation of said recording means, a second said region being devoted to the storage of voice data inputted after initiation of operation of said recording means in response to the output of said level detector, said data being stored in said first memory region upon setting of said timepiece in a record mode.

2. An electronic timepiece as claimed in claim 1, further comprising a reference voltage source, and wherein said level detector comprises a voltage comparator and a set-reset circuit, said comparator comparing said externally input voice signal with a signal provided by said reference voltage source, the output of said comparator changing state when the level of said voice signal exceeds the level of said reference voltage, the output of said comparator acting to set said set-reset circuit, the output of said set-reset circuit, when set, initiating operation of said recording means.

3. An electronic timepiece as claimed in claim 1, wherein said level detector is a gate receiving the voice signal input to said microphone means, and a set-reset circuit, a change of state at the output of said gate caused by said incoming voice signal exceeding a predetermined level setting said set-reset circuit, the output of said set-reset circuit, when set, initiating operation of said recording means.

4. An electronic timepiece as claimed in claim 1, further comprising a flip-flop circuit, and wherein said level detector is a Schmitt trigger circuit receiving said incoming voice signal, the output of said Schmitt trigger circuit, when triggered by the voice signal, changing the output state of said flip-flop, said changed state of said flip-flop initiating operation of said recording means.

5. An electronic timepiece as claimed in claim 1, wherein said level detector comprises a delta modulation circuit providing outputs changing in state in response to the level and slope of said voice signal, and further comprising a flip-flop, the output of said modulation circuit providing a clock signal for said flip-flop, the output of said flip-flop initiating operation of said recording means.

6. An electronic timepiece as claimed in claim 1, wherein said first memory region is a recirculating memory having a plurality of addresses for data storage, said addresses being selected in sequence in a recirculating mode providing a continuously available storage capacity of limited size.

7. An electronic timepiece as claimed in claim 6, wherein said first memory region receives data of the microphone output continuously until said output signal from said level detector causes said recording means to store data in said second memory region.

8. An electronic timepiece as claimed in claim 7, and further comprising switching means for first connecting said first memory region for writing data therein, and then connecting said second memory regions for writing data upon setting said timepiece in a record mode.

9. An electronic timepiece as claimed in claim 7 or 8, and further comprising switching means for first connecting said first memory region for reading of said data stored therein, and then connecting said second memory region for reading of said data stored therein upon setting said timepiece in a playback mode.

10. An electronic timepiece as claimed in claim 9, wherein recording and playback modes are set by switch means operated by the user of said timepiece.

11. An electronic timepiece as claimed in claim 1, wherein said stored data is in digital format, and further comprising converter means to digitize said incoming voice signals, and to convert data read from memory means to analog form.

12. An electronic timepiece as claimed in claim 10, wherein said stored data is in digital format, and further comprising converter means to digitize said incoming voice signal, and to convert data read from storage to analog form.

13. An electronic timepiece as claimed in claim 6, wherein said first memory region is substantially smaller in capacity than said second memory region.

14. An electronic timepiece as claimed in claim 9, and further comprising latch means, said latch means storing the address of said first memory region when the output of said level detector initiates recording in said second memory region.

15. An electronic timepiece as claimed in claim 14, wherein said switching means is adapted to initiate readout of said first memory region for playback at the address in said first memory region following said address stored by said latch means, continuity of voice data in said first and second memory regions being provided in playback.

16. In a recording apparatus, the improvement therein comprising:

a microphone and loudspeaker means for receiving and outputting voice signals;

recording means for receiving said voice signals from said microphone means and storing voice data representative of said voice signals;

output means for reading out the data stored in said recording means and transforming said data signals into voice signals for output by said loudspeaker means;

a start circuit including a level detector, said level detector detecting the amplitude of voice signals inputted externally to said microphone means, said start circuit initiating operation of said recording means in response to an output from said level detector, said level detector providing said output when the amplitude of said incoming voice signal to said microphone exceeds a predetermined level, said recording means including memory means for storage of said voice data, said memory means being divided into regions, a first region of said memory means storing said voice data incoming prior to occurrence of said signal from said level detector initiating operation of said recording means, a second said region being devoted to the storage of voice data inputted after initiation of operation of said recording means in response to the output of said level detector, said data being stored in said first memory region when desired.

17. A recording apparatus as claimed in claim 16, further comprising a reference voltage source, and wherein said level detector comprises a voltage comparator and a set-reset circuit, said comparator comparing said externally input voice signal with a signal provided by said reference voltage source, the output of said comparator changing state when the level of said voice signal exceeds the level of said reference voltage, the output of said comparator acting to set said set-reset circuit, the output of said set-reset circuit, when set, initiating operation of said recording means.

18. A recording apparatus as claimed in claim 16, wherein said level detector is a gate receiving the voice signal input to said microphone means, and a set-reset circuit, a change of state at the output of said gate caused by said incoming voice signal exceeding a predetermined level setting said set-reset circuit, the output of said set-reset circuit, when set, initiating operation of said recording means.

19. A recording apparatus as claimed in claim 16, further comprising a flip-flop circuit, and wherein said level detector is a Schmitt trigger circuit receiving said incoming voice signal, the output of said Schmitt trigger circuit, when triggered by the voice signal, changing the output state of said flip-flop, said changed state of said flip-flop initiating operation of said recording means.

20. A recording apparatus as claimed in claim 16, wherein said level detector comprises a delta modulation circuit providing outputs changing in state in response to the level and slope of said voice signal, and further comprising a flip-flop, the output of said modulation circuit providing a clock signal for said flip-flop, the output of said flip-flop initiating operation of said recording means.

21. A recording apparatus as claimed in claim 16, wherein said first memory region is a recirculating memory having a plurality of addresses for data storage, said addresses being selected in sequence in a recirculating mode providing a continuously available storage capacity of limited size.

22. A recording apparatus as claimed in claim 21, wherein said first memory region receives data of the microphone output continuously until said output signal from said level detector causes said recording means to store data in said second memory region.

23. A recording apparatus as claimed in claim 22, and further comprising switching means for first connecting said first memory region for writing data therein, and then connecting said second memory regions for writing data upon setting said recording apparatus in a record mode.

24. A recording apparatus as claimed in claim 22 or 23, and further comprising switching means for first connecting said first memory region for reading of said data stored therein, and then connecting said second memory region for reading of said data stored therein upon setting said recording apparatus in a playback mode.

25. A recording apparatus as claimed in claim 24, wherein recording and playback modes are set by switch means operated by the user.

26. A recording apparatus as claimed in claim 16, wherein said stored data is in digital format, and further comprising converter means to digitize said incoming voice signals, and to convert data read from memory means to analog form.

27. A recording apparatus as claimed in claim 25, wherein said stored data is in digital format, and further comprising converter means to digitize said incoming voice signal, and to convert data read from storage to analog form.

28. A recording apparatus as claimed in claim 21, wherein said first memory region is substantially smaller in capacity than said second memory region.

29. A recording apparatus as claimed in claim 24, and further comprising latch means, said latch means storing the address of said first memory region when the output of said level detector initiates recording in said memory region.

30. A recording apparatus as claimed in claim 29, wherein said switching means is adapted to initiate readout of said first memory region for playback at the address in said first memory region following said address stored by said latch means, continuity of voice data in said first and second memory regions being provided in playback.

31. In a recording apparatus, the improvement therein comprising:

microphone means for receiving voice signals;

first converter means for digitizing voice signals received by said microphone means, said converter means comprising a comparator having the voice signal and an analog signal as an inputs and having a comparison signal in serial digitized form representing the difference between the two input signals as an output, a control circuit having the serial comparison signal as an input and having a parallel digitized comparison signal as an output, and a digital-to-analog converter having the parallel comparison signal as an input and having the analog signal as an output which is fed to said comparator;

recording means comprising a RAM for receiving said digitized voice signals and storing them in digital format;

second converter means for reading out the data stored in said recording means and transforming the data read out into analog voice signals for output; and start circuit means having one of the serially digitized comparison signal and the parallel digitized comparison signal as an input, said start circuit means comprising detector means for initiating operation of said recording means when the amplitude of a voice signal input to said microphone means exceeds a predetermined level.

32. In a recording apparatus, the improvement therein comprising:

microphone means for receiving voice signals;

converter means for digitizing said incoming voice signals from said microphone means;

recording means for receiving signals from said converter means and storing voice data in digital format representative of voice signals, said recording means starting to record in response to a control signal, said recording means being a RAM which is divided into regions, a first region storing said incoming voice data prior to receipt of a control signal, a second region being devoted to the storage of voice data inputted after receipt of the control signal, and means for storing said data in said first memory region when desired;

output means for reading out the data stored in said recording means and transforming said data signals into voice signals for output; and a start circuit including a level detector for detecting the amplitude of voice signals inputted externally to said microphone means to provide the control signal for initiating operation of said recording means in response to an output from said level detector, said level detector providing said control signal when the amplitude of said incoming voice signal to said microphone signal exceeds a predetermined level.

33. An electronic timepiece as claimed in claim 32, wherein said first memory region is arranged in a recirculating manner and has a plurality of addresses for data storage, said addresses being selected in sequence in a recirculating mode providing a continuously available storage capacity of limited size.

34. An electronic timepiece as claimed in claim 33, wherein said first memory region receives data of the microphone output continuously until said output signal from said level detector causes said recording means to store data in said second memory region.

35. An electronic timepiece as claimed in claim 34, and further comprising switching means for first connecting said first memory region for writing data therein, and then connecting said second memory regions for writing data upon setting said timepiece in a record mode.

36. An electronic timepiece as claimed in claim 34 or 35, and further comprising switching means for first connecting said first memory region for reading of said data stored therein, and then connecting said second memory region for reading of said data stored therein upon setting said timepiece in a playback mode.

37. An electronic timepiece as claimed in claim 36, wherein recording and playback modes are set by switch means operated by the user of said timepiece.

38. An electronic timepiece as claimed in claim 32, wherein said storage data is in digital format, and further comprising converter means to digitize said incoming voice signal, and to convert data read from storage to analog form.

39. An electronic timepiece as claimed in claim 33, wherein said first memory region is substantially smaller in capacity than said second memory region.

40. An electronic timepiece as claimed in claim 36, and further comprising latch means, said latch means storing the address of said first memory region when the output of said level detector initiates recording in said second memory region.

41. An electronic timepiece as claimed in claim 40, wherein said switching means is adapted to initiate readout of said first memory region for playback at the address in said first memory region following said address stored by said latch means, continuity of voice data in said first and second memory regions being provided in playback.

* * * * *